US005507352A

United States Patent [19]

Frisbee et al.

[11] Patent Number: 5,507,352

[45] Date of Patent: Apr. 16, 1996

[54] BLOCK APPARATUS AND METHOD FOR CHANGING DOZER BLADE PITCH

[75] Inventors: Claude M. Frisbee; Ronald H. Werner, both of Burlington, Iowa

[73] Assignee: Case Corporation, Racine, Wis.

[21] Appl. No.: 328,509

[22] Filed: Oct. 25, 1994

[51] Int. Cl.[6] ..... E02F 3/815

[52] U.S. Cl. ..... 172/818; 172/821

[58] Field of Search ..... 111/137; 172/277, 172/821, 812, 816, 818, 804, 805, 827; 37/266, 273, 274

[56] References Cited

U.S. PATENT DOCUMENTS

| | | | |
|---|---|---|---|
| 3,933,260 | 11/1976 | Kronlokken et al. | 214/138 R |
| 3,991,832 | 11/1976 | Cooper | 172/821 X |
| 4,074,769 | 2/1978 | Frisbee | 172/804 |
| 4,270,617 | 6/1981 | Cantarella et al. | 172/821 |
| 4,450,917 | 5/1984 | Hake | 172/328 |
| 4,570,367 | 2/1986 | Oya | 172/816 X |
| 4,638,869 | 1/1987 | Murphy et al. | 172/821 |
| 4,828,044 | 5/1989 | Horsch et al. | 172/821 |
| 4,828,045 | 5/1989 | Horsch et al. | 172/821 |
| 4,893,683 | 1/1990 | Horsch et al. | 172/821 |
| 5,074,227 | 12/1991 | Schwitters | 111/137 |
| 5,333,697 | 8/1994 | Frisbee et al. | 172/821 |

OTHER PUBLICATIONS

Case Corporation Sheet 1150D Dozer Hydraulic Pitch Adjustment.

Photo Sheet–Deer & Co. Pitch Adjustment.

Caterpillar Co.–P. 48 Operation Section Machine Adjustments.

*Primary Examiner*—Terry Lee Melius

*Assistant Examiner*—Robert Pezzuto

*Attorney, Agent, or Firm*—Jansson & Shupe, Ltd.

[57] ABSTRACT

A dozer blade pitch adjustment apparatus has a mounting lug and a block supported by the lug for setting a dozer blade at a first pitch or a second pitch. In the improvement, the lug has a mounting surface and the block has a first face contacting such mounting surface when the blade is set at the first pitch. A second face of the block contacts the mounting surface when the blade is set at the second pitch. The block has a surface portion between the lugs and such portion faces generally upwardly when the blade is set at either pitch. A new method for changing the pitch of the blade is also disclosed.

10 Claims, 5 Drawing Sheets

BLOCK APPARATUS AND METHOD FOR CHANGING DOZER BLADE PITCH

FIELD OF THE INVENTION

This invention relates generally to mobile machinery and, more particularly, to earth-moving machinery.

BACKGROUND OF THE INVENTION

The broad class of equipment known as mobile machinery includes machines known as dozers (sometimes called "bull-dozers") which have a front-mounted blade for moving and removing earth as well as other materials atop or near the earth surfaces. Such dozers are sometimes mounted on rubber tires for propulsion. however, urging the dozer blade through the earth requires very high forward force and for that reason, crawler-mounted dozers are in wide use.

Such dozers are propelled by tracks (much like a military tank) and are capable of exerting high forward force on the blade. Such force is possible since the tracks bite into and engage the ground. Track-ground engagement is quite satisfactory for dozer operations and it is sometimes said the track and the ground are "geared" to one another like gear teeth are engaged.

Dozers remove earth in much the same way that a wood plane shaves wood, i.e., by passing a blade across the earth surface and "rolling up" a layer of earth. Such dozers are employed for road construction and to "shape" the exposed surface of the earth to some contour. They are also used to urge earth to one side or the other of the dozer's travel path rather than merely to push earth straight ahead.

The dozer operator is able to raise or lower the blade and to "skew" it left or right. It is this latter capability which permits earth to be urged to one side or the other. And the operator can also tilt the blade so that one end is higher than the other.

The operator is also able to orient the blade at a different "pitch" which means the blade can be rotated slightly about an axis extending across the blade. To put it another way, the orientation of the blade can be changed so that the blade "faces" upward more or less.

While adjustment of pitch is done relatively infrequently, the ability to do so is important at least for the following reasons. In hard earth or other material, the lower blade cutting edge can be positioned closer to vertical to better penetrate such material. On the other hand, when the blade is "laid back," the capacity of such blade to carry soft material is increased.

Manufacturers of dozers provide for blade pitch adjustment in a variety of ways. One way involves removing bolts at an attachment point near the lower rear of the blade and adding or removing shims to change blade pitch. Another way is by extending and retracting hydraulic cylinders to change such pitch. Yet another way involves a swinging link pivotably pinned at one end and having two apertures, either of which can accept a blade pin. Blade pitch is a function of which aperture is selected. It is understood that not all related parts are used in both blade pitch positions and this would present the risk of losing unused parts.

An arrangement involving hydraulic cylinders for pitch adjustment is shown in U.S. Pat. No. 4,074,769 (Frisbee). Yet another arrangement for changing blade pitch is shown in U.S. Pat. No. 4,893,683 (Horsch et al.). That of the Frisbee patent includes a plate with several sets of bolt holes. Pitch is changed by removing the bolts, moving the plate until another set of its holes is aligned with the bolt holes and re-installing the bolts. The arrangement of the Horsch et al. patent involves reversing the positions of two bearing plates which are of differing thicknesses.

Still another arrangement is shown in U.S. Pat. No. 5,333,697 (Frisbee et al.) and includes a flip block mounted on trunnions positioned toward one edge of the block. The block is rotated about 180° on the trunnions to either one of two available positions, each of which "sets" the blade at a different pitch.

While these arrangements have been generally satisfactory, some of them are attended by certain disadvantages. For example, in the arrangement involving the installation or removal of shims, the work must be performed near ground level and upon a mechanism which, more likely than not, is caked with dirt. And, of course, the arrangement assumes that the required shims will be readily available when needed—such assumption is not always correct.

While the use of hydraulic cylinders is very convenient for the operator, it is more costly to manufacture (and buy) in that the cylinders, hydraulic plumbing and pitch control valve are all required to be installed on the dozer. The swinging link arrangement is wary difficult for one person to adjust at least in that it requires aligning a pin with a hole which may require dozer movement simultaneous with link-pin engagement. And special tools may be required to effect pitch change. As to the arrangement of the Frisbee et al. patent, it has been found that the cost to manufacture the flip block is unacceptable.

An improved apparatus to change dozer pitch which is simple and quick to use, which requires only common hand tools, which can be accomplished by one person working nominally at waist level, which makes full use of all related parts in either pitch position and which is easy to manufacture would be an important advance in the art.

OBJECTS OF THE INVENTION

It is an object of this invention to provide an improved apparatus for changing dozer blade pitch which overcomes some of the problems and shortcoming of the prior art.

Another object of this invention to provide an improved apparatus for changing dozer blade pitch which can be easily adjusted by one person.

Another object of this invention to provide an improved apparatus for changing dozer blade pitch which requires only common hand tools in use.

Still another object of this invention to provide an improved apparatus for changing dozer blade pitch which permits working well above ground level.

Yet another object of this invention to provide an improved apparatus for changing dozer blade pitch which makes full use of all related parts, irrespective of blade pitch position.

Another object of this invention to provide an improved apparatus for changing dozer blade pitch which is easy to manufacture.

Still another object of this invention is to provide an improved method for changing dozer blade pitch. How these and other objects are accomplished will become more apparent from the following descriptions and the drawing.

SUMMARY OF THE INVENTION

As a brief summary, the invention includes a unique angle-face block and a pair of angle-faced block mounting lugs. The block has first and second laterally-extending support members, each of which has a first and second angled face thereon. When the block is in the position for setting the first pitch of the blade, the first angled faces are against the angle faces of the lugs. And when the block is in the second position for setting the second blade pitch, the second angled faces are against the lug angle faces.

Stated another way, the invention is an improvement in a dozer blade pitch adjustment apparatus of the type having a mounting lug and a block supported by the lug for setting a dozer blade at a first pitch or a second pitch. In the improvement, the lug has a mounting surface and the block has a first face contacting such surface when the blade is set at the first pitch. The block also has a second face contacting the mounting surface when the blade is set at the second pitch.

In another aspect of the invention, the block has a body and the faces are generally parallel to one another and angled with respect to the body. Each of the faces defines an angle with respect to the body which is preferably less than about 90° and in a specific embodiment is about 87.5°.

In yet another aspect, the first support member of the pitch block contacts the first lug when the blade is at the first pitch and such first support member contacts the second lug when the blade is at the second pitch. Further, the block has a surface portion between the lugs and such portion faces generally upward when the blade is set at either pitch.

The invention also involves a new method for changing the pitch of a dozer blade. Such method includes the steps of removing the pitch block from the mounting lugs, rotating the pitch block about 180° and re-attaching the pitch block to the mounting lugs.

The rotating step preferably includes rotating the pitch block in a substantially horizontal plane and the re-attaching step preferably includes placing the body between the lugs. Assuming the dozer blade is initially at a first pitch, the pitch block has a surface portion at an orientation with respect to a reference plane when the blade is at such first pitch. The re-attaching step includes setting the blade at a second pitch and at the completion of the re-attaching step, the surface portion is at substantially the same orientation with respect to the reference plane.

The invention is an improvement in the arrangement shown in U.S. Pat. No. 5,333,697 (Frisbee et al.) which is incorporated herein by reference for its general teaching regarding dozers and dozer blade mounting. Further details regarding the invention are set forth in the following detailed description taken in conjunction with the drawing.

DETAILED DESCRIPTION OF PREFERRED EMBODIMENTS

Figure 1:
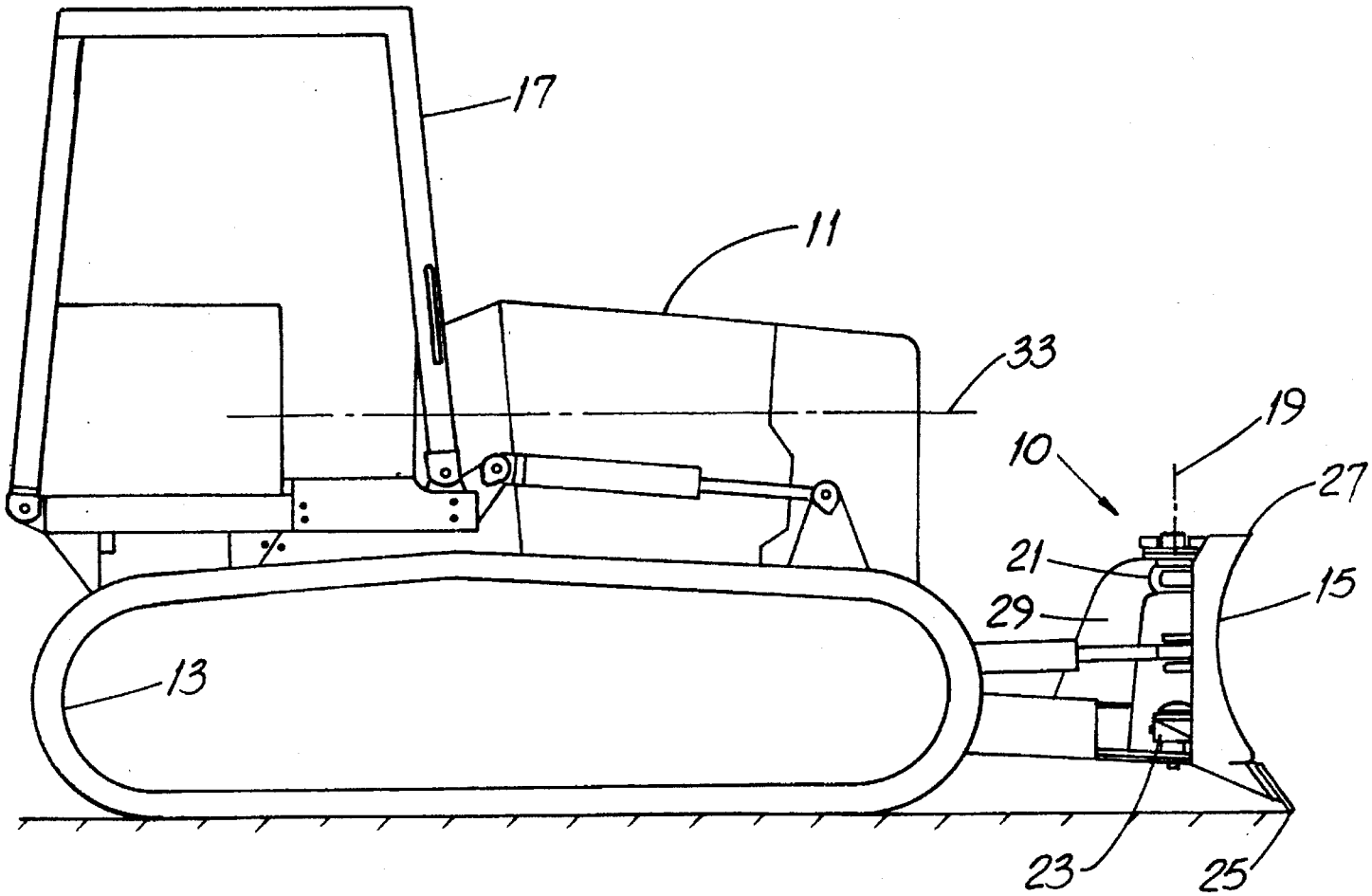
FIG. 1 is a side elevation view of a representative crawler-mounted dozer with adjustable pitch blade and incorporating the invention.

Referring first to FIG. 1, the inventive apparatus 10 is shown in conjunction with a dozer 11 (sometimes referred to as a ("bulldozer") which is mounted on crawler tracks 13 for propulsion and which is equipped with a dozer blade 15. From the seat in the cab 17, the operator can control the tilt, skew and raise/lower positions of the blade 15 to perform a particular task. When the blade 15 is angled left or right (or "skewed"), the blade 15 pivots about an axis 19 extending through the top and bottom pivot mounts 21 and 23, respectively.

From the perspective of FIG. 1, one can appreciate why the blade cutting edge 25 better penetrates hard material "chisel-like" if such edge 25 is oriented more vertically. One can also appreciate how the blade 15 can carry more material if its top edge 27 is pitched to the rear so that the blade 15 "faces" upward somewhat.

Figure 2:
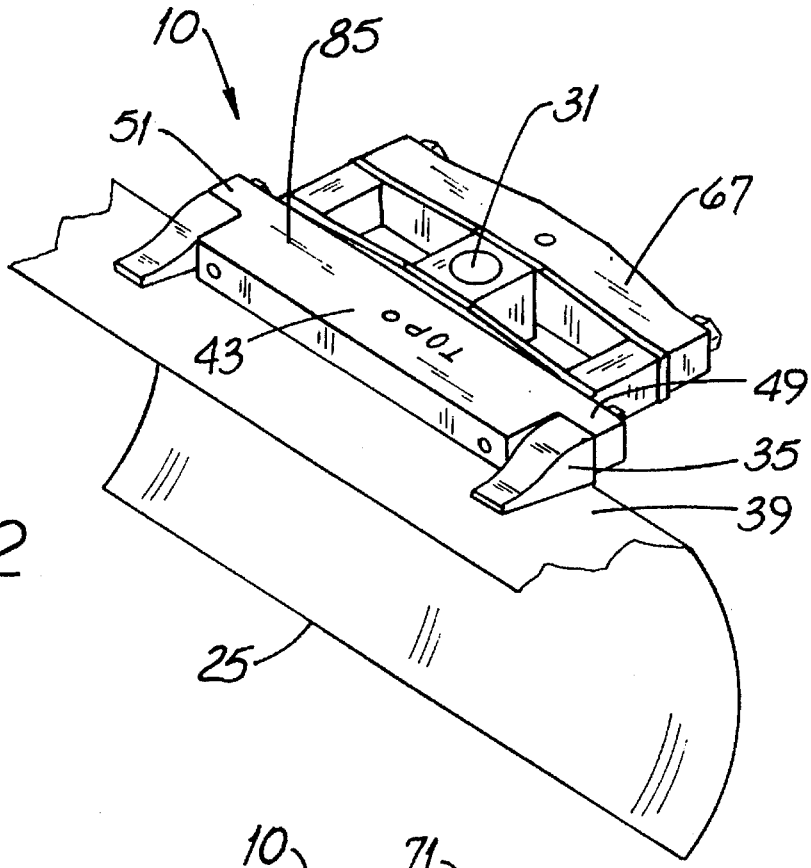
FIG. 2 is a perspective view of the inventive apparatus with the dozer blade in the first or rearward pitch position. Parts are broken away.
Figure 3:
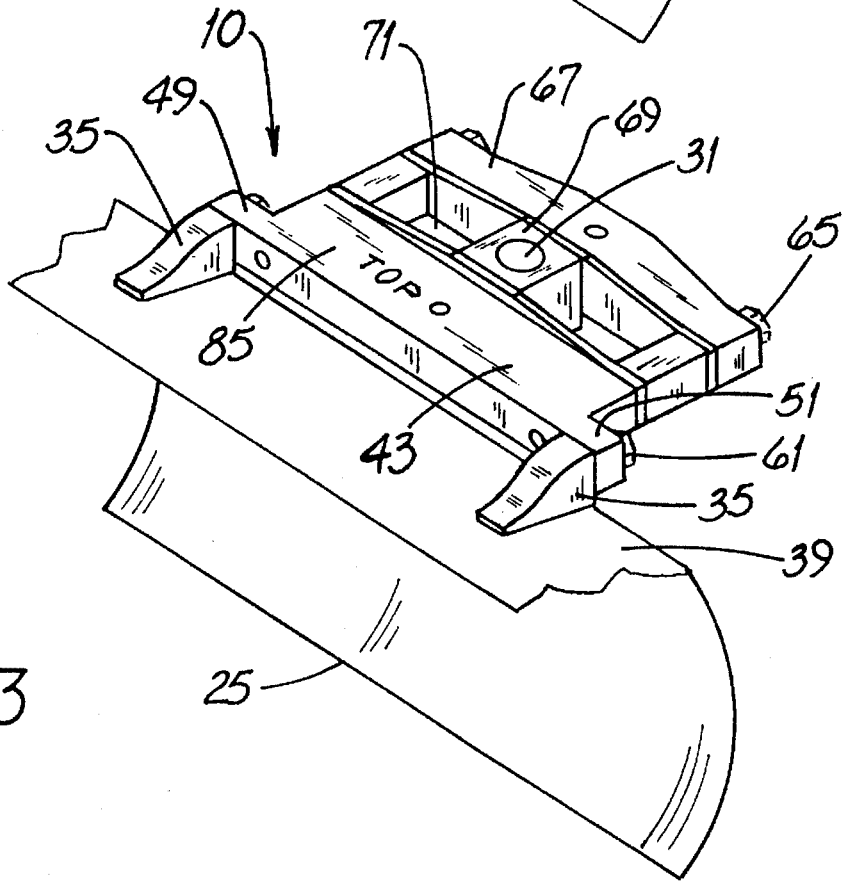
FIG. 3 is a perspective view of the inventive apparatus with the dozer blade in the second or forward pitch position. Parts are broken away.

Referring also to FIGS. 2 and 3, the blade 15 is supported by a frame member 29 to which is attached a pivot pin 31. When the dozer 11 is sitting on a horizontal surface, such pin 31 is vertical, i.e., is coincident with the axis 19. And irrespective of the nature of the surface on which the dozer 11 is sitting, the pin 31 is at right angles to the dozer long axis 33.

Figure 4:
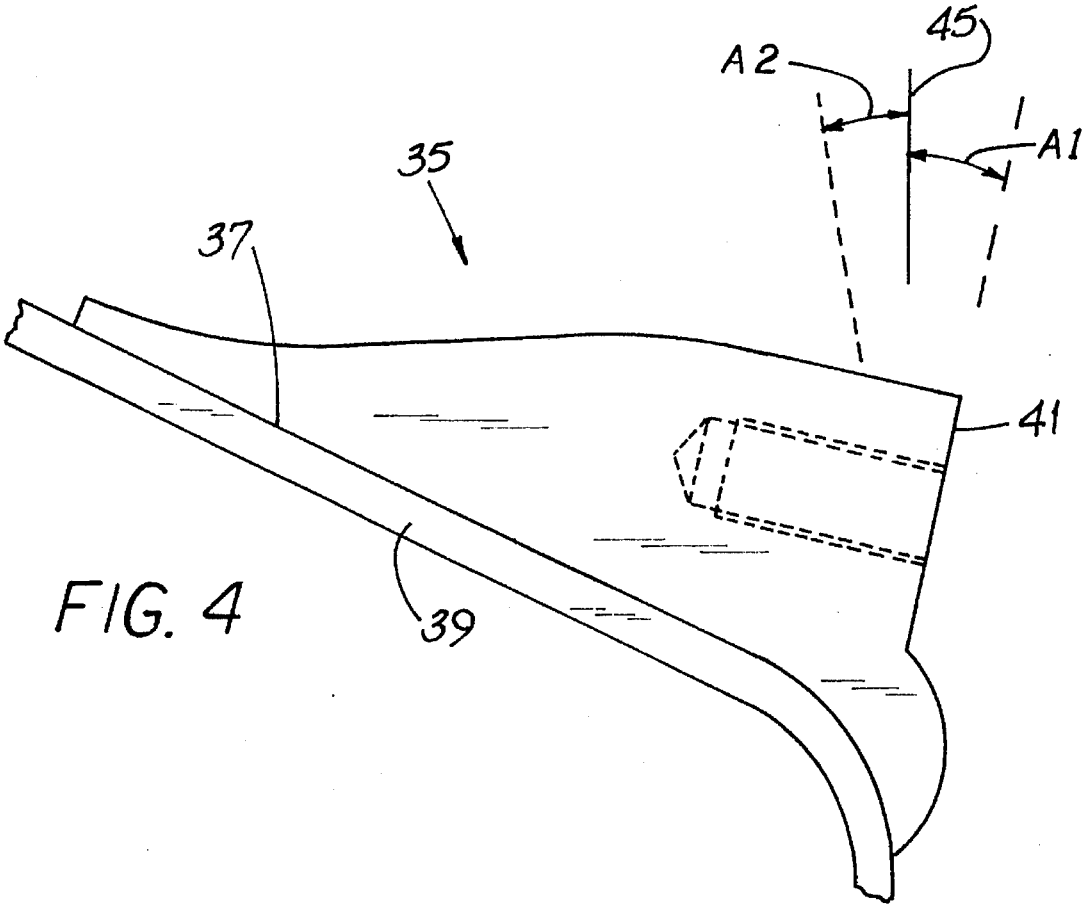
FIG. 4 is a side elevation view of a mounting lug attached to the upper rear portion of the dozer blade.

Referring also to FIG. 4, a blade mounting lug 35 will now be described. Such lug 35 has a mounting pad 37 attached to the upper rear portion 39 of the blade 15 by welding or the like. In the illustrated specific embodiment, such portion 39 angles downwardly and rearwardly at about 10° and as shown in FIGS. 2 and 3, the blade 15 is equipped with two such lugs 35 which are spaced apart.

Each lug 35 includes a generally flat mounting surface 41 to which the pitch block 43 is attached as described below. When the lugs 35 are mounted on the blade 15 as illustrated and when the blade 15 is at the first pitch position shown in FIG. 2 (with the blade top edge 27 more rearward), the lug surfaces 41 are tipped rearward at an angle "A1" to a vertical plane 45.

On the other hand, when the blade 15 is at the second pitch position shown in FIG. 3 (with the blade top edge 27 more forward), such surfaces 41 are tipped forward at the angle "A2" to the vertical plane. In a specific embodiment, the angles "A1" and "A2" are about equal to one another and are about 2.5°. In FIG. 4, the angles. "A1" and "A2" have been exaggerated for ease of understanding and it should be appreciated that for any blade pitch, the surfaces 41 of the lugs 35 remain coplanar. The two positions of the lug mounting surfaces 41 should be recalled when analyzing the following details of the pitch block 43 and how such block 43 is used.

Figure 6:
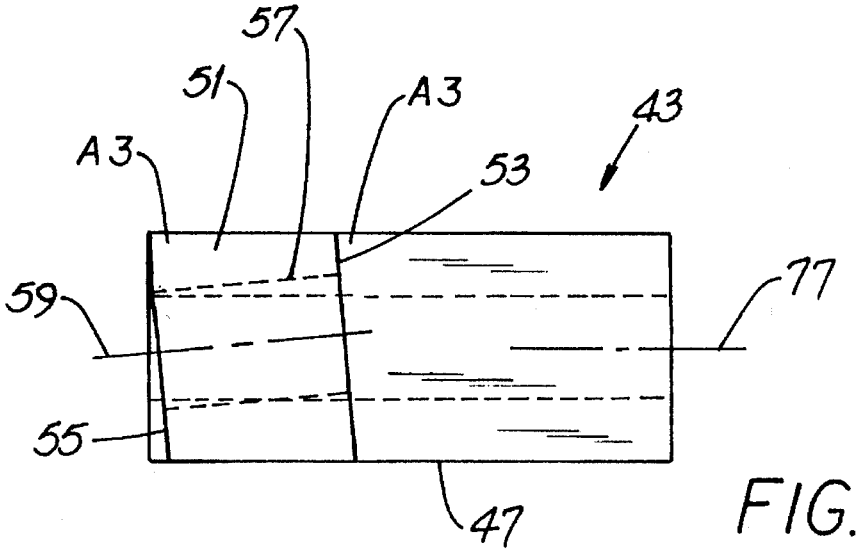
FIG. 6 is an end elevation view of the pitch block component of FIG. 5 taken in the viewing plane 6—6 thereof.
Figure 5:
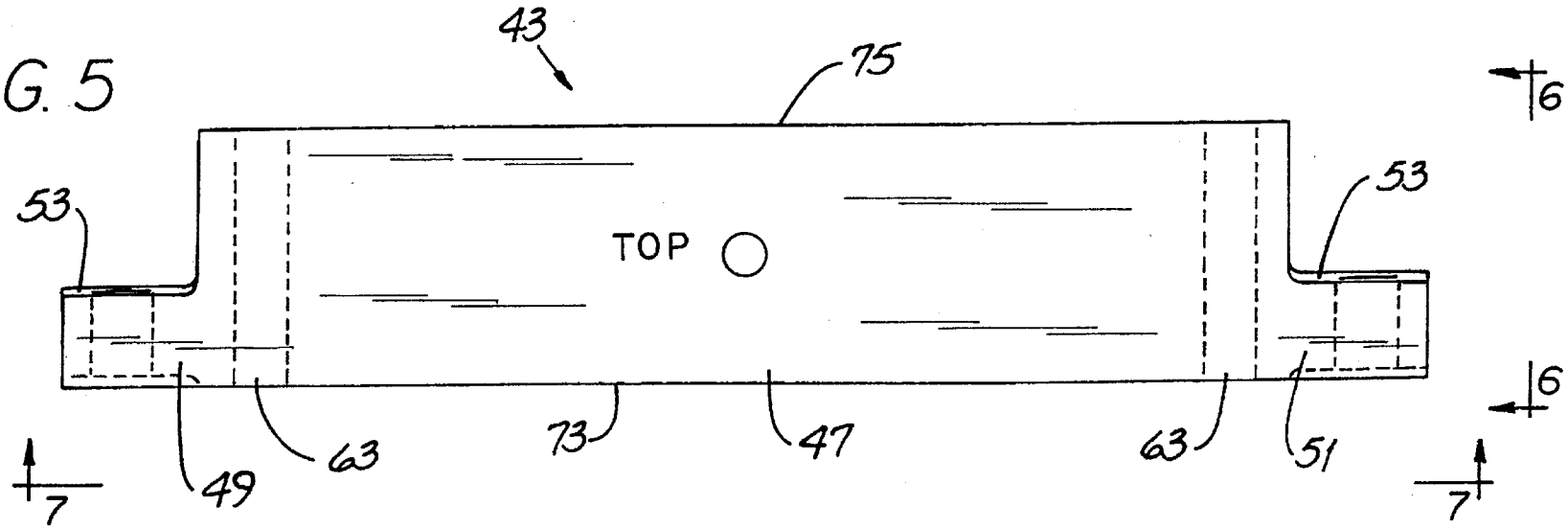
FIG. 5 is a top plan view of the pitch block component of the apparatus.
Figure 7:
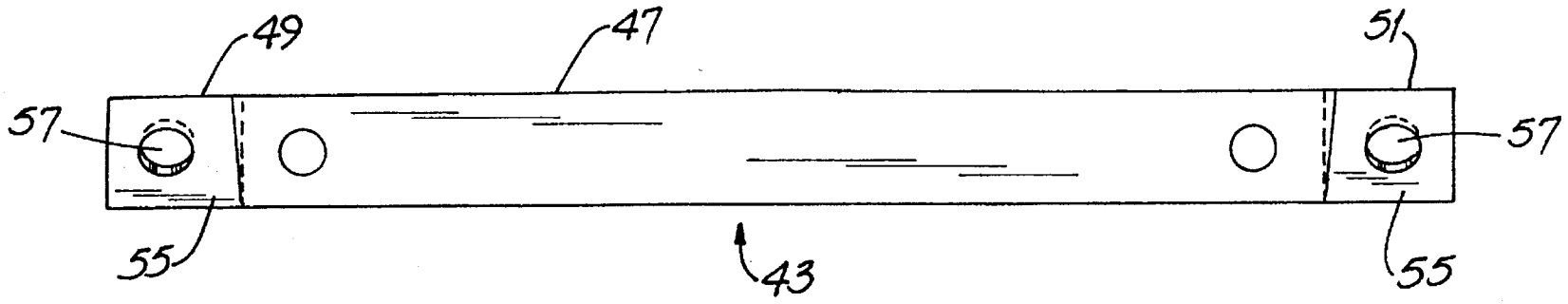
FIG. 7 is an edge elevation view of the pitch block component of FIG. 5 taken in the viewing plane 7—7 thereof.

Referring also to FIGS. 5, 6 and 7 the pitch block 43 has a body 47 and a pair of support members 49, 51 extending therefrom, one at each end of the body 47. Each member 49, 51 has a first face 53 which is angled with respect to the body 47 and which contacts a respective lug mounting surface 41 when the blade is set at the first pitch as shown in FIG. 2. Similarly, each member 49, 51 has a second face 55 angled with respect to the body 47. When the blade 15 is at the second pitch, such face 55 contacts a respective lug mounting surface 41. In one preferred embodiment, the face-body angle "A3" is less than about 90° and in a specific embodiment, such angle "A3" is about 87.5°.

Each support member 49, 51 has a bolt hole 57 therethrough and the axis 59 of each such hole 57 is perpendicular to the faces 53, 55 of that member 49, 51. The holes 57 receive bolts 61 to mount the pitch block 43 to the mounting lugs 35.

Further, the body 47 also has holes 63 therethrough to receive bolts 65 mounting the slider assembly 67 to the block 43. Such assembly 67 includes a block 69 mounted on the pivot pin 31 and free to slide laterally in the rectangular space 71. Such arrangement permits the blade 15 to tilt end-to-end while yet retaining the selected blade pitch.

From an inspection of FIGS. 2 and 3, it is apparent that when the blade 15 is set at the first pitch (FIG. 2), the slider assembly 67 is attached to the first edge 73 of the block 43 and when the blade 15 is at the second pitch (FIG. 3), such assembly 67 is attached to the second edge 75 of the block 43. It is also apparent from FIG. 6 that the long axes 77 of the holes 63 and the long axes 59 of the holes 57 are angular with respect to one another. That is, such axes 59, 77 are not parallel but (if projected to the same plane) are at an angle to one another of about 2.5° in one specific embodiment.

Figure 8:
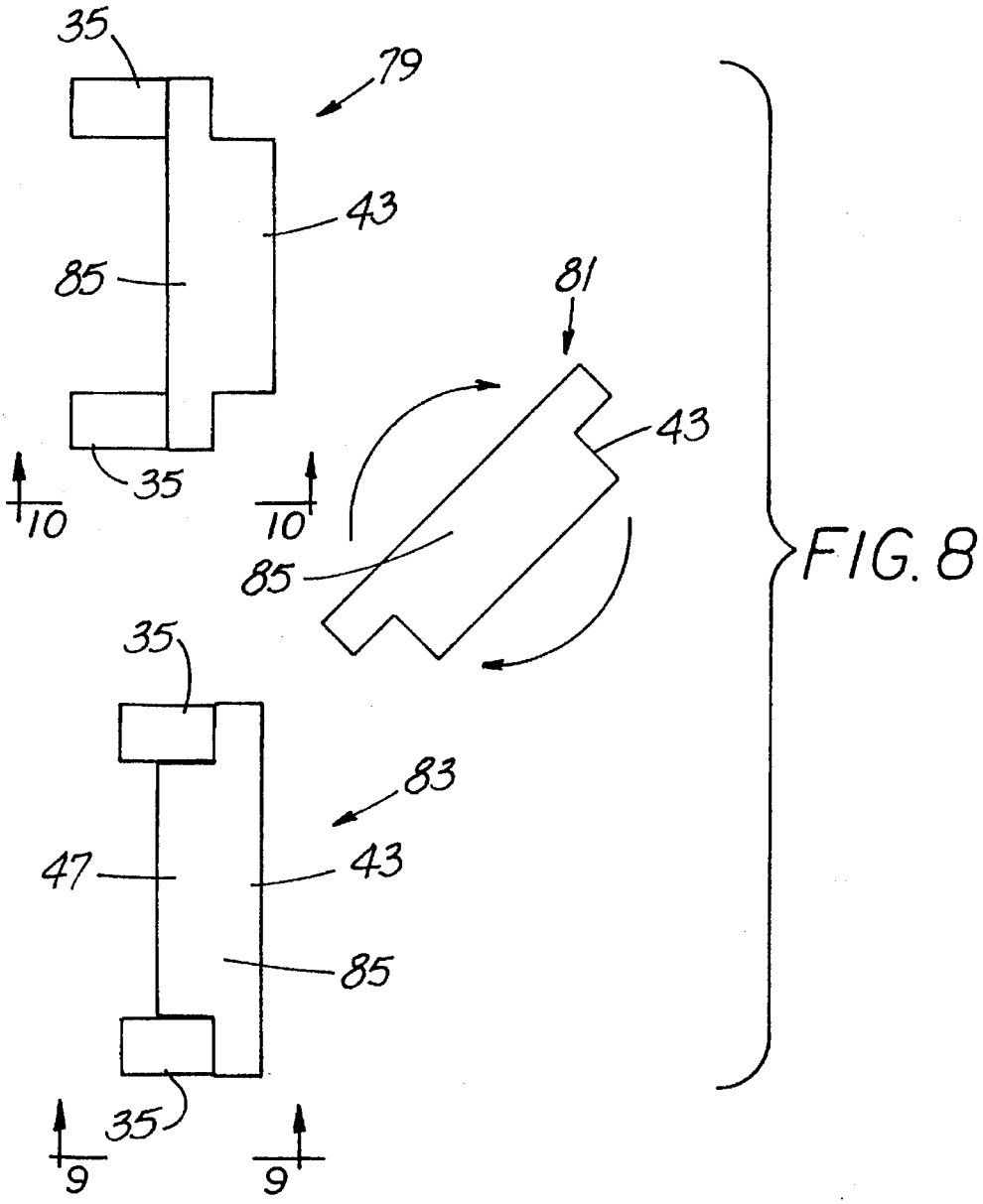
FIG. 8 is a sequence of views showing how the pitch block is rotated to change blade pitch.

Referring now to FIG. 8 (and its sequential views 79, 81 and 83), a method for changing the pitch of the blade 15 will now be described. Such method includes removing the block 43 from the mounting lugs 35 by removing the bolts 61. The block 43 is then rotated 180° in a substantially horizontal plane (a plane coinicident with the drawing sheet of FIG. 8) as illustrated by the view 81 and then re-attached to the lugs 35. If the block 43 is being moved to change the blade pitch from the second pitch to the first pitch (as would be the case when considering the views 79, 81 and 83 in that order), the re-attaching step includes placing the body 47 between the lugs 35.

Figure 9:
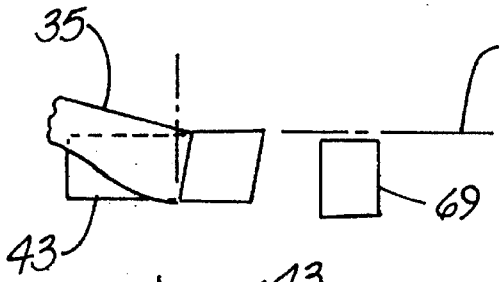
FIG. 9 is an edge view of a mounting lug and the pitch block taken in the viewing plane 9—9 of FIG. 8.
Figure 10:
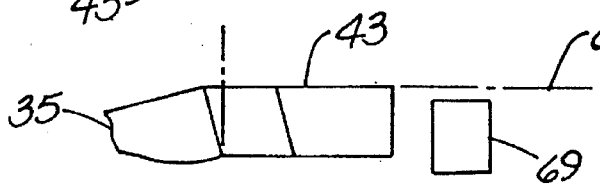
FIG. 10 is an edge view of a mounting lug and the pitch block taken in the viewing plane 10—10 of FIG. 8.

Such body 47 has a top surface portion 85 which faces generally upwardly when the blade 15 is set at either pitch. Considering FIGS. 9 and 10, such surface portion 85 of the pitch block 43 is at an orientation with respect to a reference plane 87 when the blade 15 is at the first pitch and the block 43 is positioned as shown in FIG. 9. And when the blade 15 is at the second pitch the block 43 is positioned as shown in FIG. 10 and is at substantially the same orientation with respect to the plane 87. In a specific embodiment, the block 43 is oriented parallel to such plane 87 for either blade pitch.

Aspects of the invention have been described in connection with specific embodiments. However, it will be appreciated that such invention is useful in any dozer arrangement having a structural member such as a pivot pin 31 that is at a fixed angle, e.g., vertical, with respect to some reference plane and with respect to which member the pitch of a dozer blade 15 is to be adjusted. In the specific embodiment, the slider assembly 67 as well as the pitch block 43 are substantially horizontal irrespective of blade pitch. Therefore, the pivot pin 31 and the block 69 to which such pin 31 is mounted are free to slide laterally in the assembly 67 when the blade 15 is at either pitch.

While the principles of the invention have been described in connection with only a single specific embodiment, it should be understood clearly that such description and embodiment are exemplary and not intended to be limiting.

What is claimed is:

1. In a dozer blade pitch adjustment apparatus having a mounting lug and a block supported by the lug for setting a dozer blade at a first pitch and, alternatively, a second pitch, the improvement wherein:

the lug has a mounting surface;

the block has a first face contacting the mounting surface when the blade is set at the first pitch and has a second face contacting the mounting surface when the blade is set at the second pitch.

2. The apparatus of claim 1 wherein:

the block has a body; and the faces are angled with respect to the body.

3. The apparatus of claim 2 wherein:

each of the faces defines an angle with respect to the body; and the angle is less than about 90°.

4. The apparatus of claim 3 wherein the faces are generally parallel to one another.

5. In a pitch adjustment apparatus mounted on a dozer blade and having (a) a pair of mounting lugs extending from the blade, and (b) a block supported by the lugs for setting the dozer blade at a first pitch and, alternatively, a second pitch, the improvement wherein:

the block has a surface portion between the lugs; and the surface portion faces generally upwardly when the blade is set at either pitch.

6. The apparatus of claim 5 wherein:

the pair of mounting lugs includes a first lug and a second lug;

the block has first and second support members;

the first support member contacts the first lug when the blade is at the first pitch; and the first support member contacts the second lug when the blade is at the second pitch.

7. In a dozer blade assembly having (a) a dozer blade, (b) a pair of mounting lugs, and (c) a pitch block attached to the mounting lugs, a method for changing the pitch of the blade including the steps of:

removing the pitch block from the mounting lugs;

rotating the pitch block about 180°; and re-attaching the pitch block to the mounting lugs.

8. The method of claim 7 wherein the pitch block has a body and the re-attaching step includes placing the body between the lugs.

9. The method of claim 7 wherein the rotating step includes rotating the pitch block in a substantially horizontal plane.

10. The method of claim 7 wherein:

the dozer blade is initially at a first pitch;

the pitch block has a surface portion at an orientation with respect to a reference plane when the blade is at the first pitch;

the re-attaching step includes setting the blade at a second pitch; and at the completion of the re-attaching step, the surface portion is at substantially the same orientation with respect to the reference plane.

* * * * *